US011525320B2

(12) United States Patent
Yan et al.

(10) Patent No.: US 11,525,320 B2
(45) Date of Patent: Dec. 13, 2022

(54) CASING-PROTECTIVE HORIZONTAL DIRECTIONAL DRILLING COAXIAL CORING DEVICE FOR GEOLOGICAL INVESTIGATION

(71) Applicant: China University of Geosciences (Wuhan), Hubei (CN)

(72) Inventors: Xuefeng Yan, Hubei (CN); Cong Zeng, Hubei (CN); Peng Zhang, Hubei (CN)

(73) Assignee: China University of Geosciences (Wuhan), Hubei (CN)

( * ) Notice: Subject to any disclaimer, the term of this patent is extended or adjusted under 35 U.S.C. 154(b) by 0 days.

(21) Appl. No.: 17/509,038

(22) Filed: Oct. 24, 2021

(65) Prior Publication Data

US 2022/0042387 A1 Feb. 10, 2022

(30) Foreign Application Priority Data

Jun. 11, 2021 (CN) ..... 202121316425.5

(51) Int. Cl.
*E21B 25/10* (2006.01)
*E21B 17/10* (2006.01)
*E21B 7/04* (2006.01)

(52) U.S. Cl.
CPC ..... *E21B 25/10* (2013.01); *E21B 7/046* (2013.01); *E21B 17/1078* (2013.01)

(58) Field of Classification Search
CPC ..... E21B 25/10; E21B 7/046; E21B 17/1078
See application file for complete search history.

(56) References Cited

U.S. PATENT DOCUMENTS

| | | | | |
|---|---|---|---|---|
| 2,288,542 | A * | 6/1942 | Paget | E21B 19/081 173/160 |
| 10,731,418 | B2 * | 8/2020 | Peters | E21B 17/04 |
| 2015/0211302 | A1 * | 7/2015 | Beckwith | E21B 7/26 175/45 |
| 2018/0179841 | A1 * | 6/2018 | Messa | E21B 34/14 |
| 2020/0300293 | A1 * | 9/2020 | Peters | F16C 17/18 |
| 2020/0362637 | A1 * | 11/2020 | Peters | E21B 3/00 |

* cited by examiner

*Primary Examiner* — Yong-Suk (Philip) Ro

(57) ABSTRACT

A casing-protective horizontal directional drilling coaxial coring device for geological investigation includes a casing pipe, a coring tube and a conversion adapter. Both the casing pipe and the coring tube are tubular, and the coring tube is coaxially set within the casing pipe. The conversion adapter, having a cylindrical structure fitted with the casing pipe, is coaxially set at a back end portion of the casing pipe and is slidably connected with an inner wall of the casing pipe. A screw motor is located between the conversion adapter and the coring tube, two ends of the screw motor are fixedly connected with the conversion adapter and the coring tube, respectively. Under an action of an external force, the screw motor drives the coring tube to move along an axial direction of the casing pipe till the coring tube extends out of or retracts into the casing pipe.

5 Claims, 1 Drawing Sheet

CASING-PROTECTIVE HORIZONTAL DIRECTIONAL DRILLING COAXIAL CORING DEVICE FOR GEOLOGICAL INVESTIGATION

CROSS REFERENCE OF RELATED APPLICATION

The present invention claims priority under 35 U.S.C. 119(a-d) to CN 202121316425.5, filed Jun. 11, 2021.

BACKGROUND OF THE PRESENT INVENTION

Field of Invention

The present invention relates to the field of geological investigation, and more particularly to a casing-protective horizontal directional drilling coaxial coring device for geological investigation.

Description of Related Arts

At present, traditional vertical drilling survey methods have encountered many problems. For example, the obtained stratum information is unable to meet the needs of engineering design; the effective drilling length is too low, the drilling depth is too deep, the number of drilling holes is too massive and the cost is too high; especially in high mountain areas, it is difficult to transport the drilling rigs to the mountains. However, the horizontal directional drilling technology, which is widely used in the field of pipeline laying and is relatively mature, can be applied to the survey to solve the above problems well. Moreover, horizontal directional drilling technology has the advantages of high precision, low cost and easy access to parameters.

The drilling survey of horizontal directional drilling rigs along the extension direction of the tunnel is able to solve the problems of traditional vertical drilling survey methods. However, the geological investigation coring technology with horizontal directional drilling rigs in the prior arts also faces problems such as the inconvenience of in-well power supply and the inability to ensure that the survey hole is concentric and coaxial with the full face drilling hole.

SUMMARY OF THE PRESENT INVENTION

In order to overcome the shortcomings of the prior arts, the present invention provides a casing-protective horizontal directional drilling coaxial coring device for geological investigation.

the device comprises a casing pipe, a coring tube and a conversion adapter, wherein:

both the casing pipe and the coring tube are tubular, and the coring tube is coaxially set within the casing pipe;

the conversion adapter, having a cylindrical structure fitted with the casing pipe, is coaxially set at a back end portion of the casing pipe and is slidably connected with an inner wall of the casing pipe;

a screw motor is located between the conversion adapter and the coring tube, two ends of the screw motor are fixedly connected with the conversion adapter and the coring tube, respectively;

under an action of an external force, the screw motor drives the coring tube to move along an axial direction of the casing pipe till the coring tube extends out of or retracts into the casing pipe;

the conversion adapter has a through-hole which is provided along an axial direction thereof;

the conversion adapter and the screw motor are communicated with the coring tube.

Preferably, the casing pipe comprises an arched transition portion at a front end thereof, a first centralizer is axially set at the front end of the casing pipe, a second centralizer is axially set a front portion of the casing pipe, the coring tube penetrates through the first centralizer and the second centralizer in sequence, the first centralizer and the second centralizer are fixedly connected with the inner wall of the casing pipe.

Preferably, a sealing piece is provided at the front end of the casing pipe and is fitted with a pipe diameter thereof.

Preferably, the sealing piece is made from granite.

Preferably, a sealing ring is axially set at the back end of the casing pipe.

The beneficial effects of the technical scheme provided by the device are as follows: it is able to realize horizontal directional drilling of the core, is simple and easy to access in drilling power source, and also ensures that the survey hole is concentrically and coaxially provided with the full face drilling hole. At the same time, the casing pipe is able to ensure that the drilling is not affected by hole collapse and block falling. Moreover, the coring device has advantages of simple structure, low cost and high coring rate.

DETAILED DESCRIPTION OF THE PREFERRED EMBODIMENT

In order to make the objectives, technical solutions and advantages of the present invention clearer, the present invention is further described in detail with accompanying drawings as follows.

Figure 1:
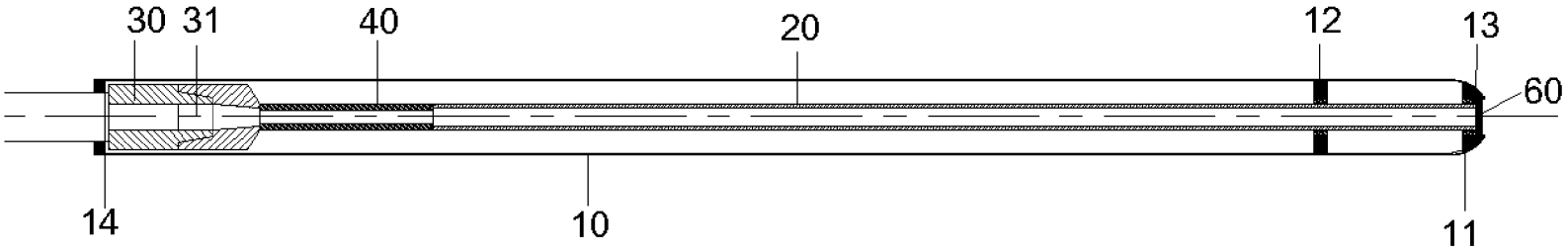
FIG. 1 is a structurally schematic view of a casing-protective horizontal directional drilling coaxial coring device for geological investigation provided by the present invention.
Figure 2:
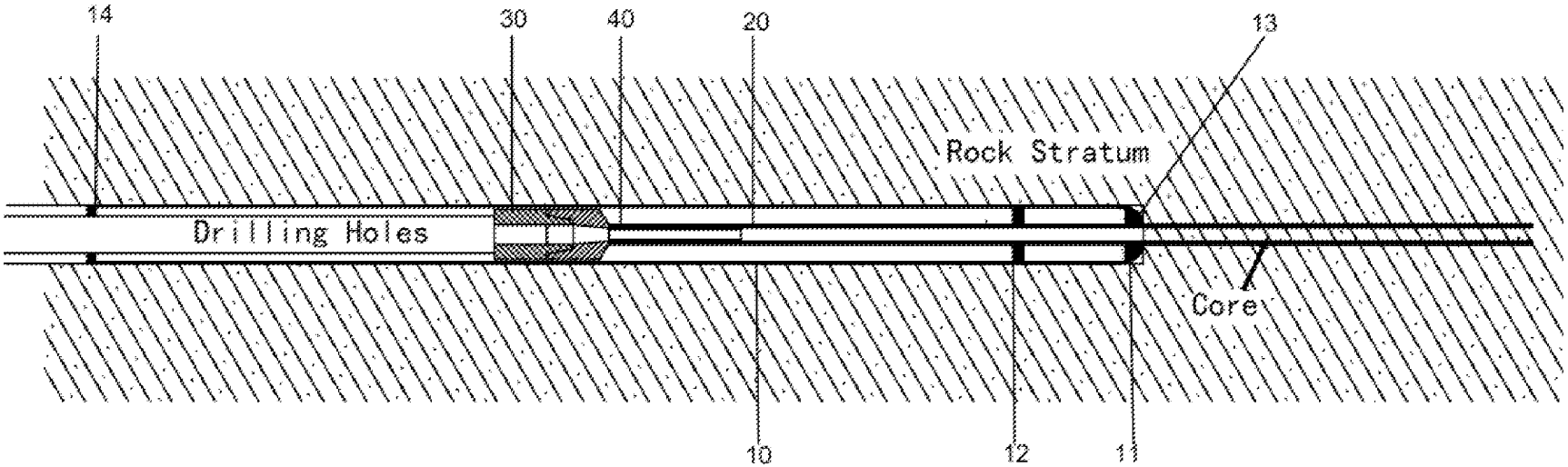
FIG. 2 is the other structurally schematic view of the casing-protective horizontal directional drilling coaxial coring device for geological investigation provided by the present invention.

Referring to FIGS. 1 and 2, a casing-protective horizontal directional drilling coaxial coring device for geological investigation according to a preferred embodiment of the present invention is illustrated, wherein the coring device comprises a casing pipe 10, a coring tube 20 and a conversion adapter 30. Both the casing pipe 10 and the coring tube 20 are tubular, and the coring tube 20 is coaxially set within the casing pipe 10. The conversion adapter 30, having a cylindrical structure fitted with the casing pipe 10, is coaxially set at a back end portion of the casing pipe 10 and is slidably connected with an inner wall of the casing pipe 10. A screw motor 40 is located between the conversion adapter 30 and the coring tube 20, two ends of the screw motor 40 are fixedly connected with the conversion adapter 30 and the coring tube 20, respectively. Under an action of an external force, the screw motor 40 drives the coring tube 20 to move along an axial direction of the casing pipe 10 till the coring tube 20 extends out of or retracts into the casing pipe 10. The conversion adapter 30 has a through-hole 31 which is provided along an axial direction thereof. The conversion adapter 30 and the screw motor 40 are communicated with the coring tube 20.

According to the preferred embodiment of the present invention, the casing pipe 10 is able to ensure that the drilling is not affected by hole collapse and block falling. The conversion adapter 30 is in a threaded or clamped connection with a drill rod. An outer wall of the conversion adapter 30 is in a sealed connection with the inner wall of the casing pipe 10. The coring tube 20 is configured to drill the core, and a gap is provided between an outer wall of the coring tube 20 and the inner wall of the casing pipe 10, which is convenient for movement of the coring tube 20. According to the preferred embodiment, the external force is a driving force provided by drilling fluid or mud; the drilling fluid or mud enter the screw motor 40 through the conversion adapter 30, the screw motor 40 drives the coring tube 20 to rotate and move under an action of a thrust force from the drill rod, till a front end of the coring tube 20 extends out of the casing pipe 10. The coring device provided by the present invention is able to realize horizontal directional drilling of the core, is simple and easy to access in drilling power source, and also ensures that the survey hole is concentrically and coaxially provided with the full face drilling hole.

According to the preferred embodiment of the present invention, the casing pipe 10 comprises an arched transition portion 11 at a front end thereof, a first centralizer 12 is axially set at the front end of the casing pipe 10, a second centralizer 13 is axially set a front portion of the casing pipe 10, the coring tube 20 penetrates through the first centralizer 12 and the second centralizer 13 in sequence, the first centralizer 12 and the second centralizer 13 are fixedly connected with the inner wall of the casing pipe 10.

According to the preferred embodiment of the present invention, the arched transition portion 11 is able to reduce the resistance of the casing pipe 10 during drilling and ensure the moving efficiency of the coring device. Both the first centralizer 12 and the second centralizer 13 are able to be bearings or copper sheets for preventing the coring tube 20 from swinging randomly, so as to ensure the directionality and coring rate while drilling the core through the coring tube 20. The first centralizer 12 is fitted with the arched transition portion 11 to provide support for the coring tube 20.

According to the preferred embodiment of the present invention, a sealing piece 60 is provided at the front end of the casing pipe 10 and is fitted with a pipe diameter thereof.

According to the preferred embodiment of the present invention, the sealing piece 60 is configured to seal the front end of the casing pipe 10, so as to prevent impurities from entering the coring tube 20 during the drilling of the casing pipe 10, thereby affecting the quality of the core. When the casing pipe 10 moves to a coring position, the coring tube 20 is able to penetrate through the sealing piece 60 and extend out of the casing pipe 10 during the forward movement of the coring tube 20. Preferably, the sealing piece 60 is made from granite, which has excellent strength and stability.

According to the preferred embodiment of the present invention, a sealing ring 14 is axially set at a back end of the casing pipe 10 for fixing the drill rod and preventing the drill rod from falling off.

In the above description, the directional terms such as "front", "back", "upper" and "lower" are defined in terms of the positions of the parts in the drawings and the positions between the parts in the drawings, which is just for the clarity and convenience of expressing technical solutions. It should be understood that the use of the directional terms should not limit the protection scope of the present invention.

In the case of no conflict, the above-mentioned embodiment and the features in the embodiment herein are able to be combined with each other.

The above is only the preferred embodiment of the present invention and is not intended to limit the present invention. Any modification, equivalent replacement and improvement made within the spirit and principle of the present invention shall be included in the protection scope of the present invention.

What is claimed is:

1. A casing-protective horizontal directional drilling coaxial coring device for geological investigation, the coring device comprising a casing pipe (10), a coring tube (20) and a conversion adapter (30), wherein:

both the casing pipe (10) and the coring tube (20) are tubular, and the coring tube (20) is coaxially set within the casing pipe (10);

the conversion adapter (30), having a cylindrical structure fitted with the casing pipe (10), is coaxially set at a back end portion of the casing pipe (10) and is slidably connected with an inner wall of the casing pipe (10);

a screw motor (40) is located between the conversion adapter (30) and the coring tube (20), two ends of the screw motor (40) are fixedly connected with the conversion adapter (30) and the coring tube (20), respectively;

under an action of an external force, the screw motor (40) drives the coring tube (20) to move along an axial direction of the casing pipe (10) till the coring tube (20) extends out of or retracts into the casing pipe (10);

the conversion adapter (30) has a through-hole (31) which is provided along an axial direction thereof;

the conversion adapter (30) and the screw motor (40) are communicated with the coring tube (20).

2. The casing-protective horizontal directional drilling coaxial coring device for geological investigation according to claim 1, wherein the casing pipe (10) comprises an arched transition portion (11) at a front end thereof, a first centralizer (12) is axially set at the front end of the casing pipe (10), a second centralizer (13) is axially set a front portion of the casing pipe (10), the coring tube (20) penetrates through the first centralizer (12) and the second centralizer (13) in sequence, the first centralizer (12) and the second centralizer (13) are fixedly connected with the inner wall of the casing pipe (10).

3. The casing-protective horizontal directional drilling coaxial coring device for geological investigation according to claim 2, wherein a sealing piece (60) is provided at the front end of the casing pipe (10) and is fitted with a pipe diameter thereof.

4. The casing-protective horizontal directional drilling coaxial coring device for geological investigation according to claim 3, wherein the sealing piece (60) is made from granite.

5. The casing-protective horizontal directional drilling coaxial coring device for geological investigation according to claim 1, wherein a sealing ring (14) is axially set at a back end of the casing pipe (10).

* * * * *